US005244305A

United States Patent [19]

Lindley

[11] Patent Number: 5,244,305

[45] Date of Patent: Sep. 14, 1993

[54] CONCRETE STRIKING EQUIPMENT

[76] Inventor: Thomas R. Lindley, 7845 Wice Church Rd., Boaz, Ky. 42027

[21] Appl. No.: 892,244

[22] Filed: Jun. 2, 1992

Related U.S. Application Data

[63] Continuation-in-part of Ser. No. 619,497, Nov. 29, 1990, abandoned.

[51] Int. Cl.[5] ..... E01C 19/22

[52] U.S. Cl. ..... 404/97; 404/133.2

[58] Field of Search ..... 173/29, 123; 404/97, 404/133, 133.2

[56] References Cited

U.S. PATENT DOCUMENTS

| | | | |
|---|---|---|---|
| 1,955,101 | 4/1934 | Sloan . | |
| 2,180,198 | 11/1939 | Day . | |
| 2,255,343 | 9/1941 | Baily . | |
| 2,303,335 | 12/1942 | Day . | |
| 2,314,985 | 3/1943 | Jackson . | |
| 2,386,662 | 10/1945 | Crock . | |
| 2,400,321 | 5/1946 | Troxell . | |
| 2,651,980 | 9/1953 | Wells et al. . | |
| 2,746,367 | 5/1956 | Ferguson . | |
| 3,427,939 | 2/1969 | Braff et al. | 404/133.2 |
| 3,883,259 | 5/1975 | Berg et al. . | |
| 4,043,694 | 8/1977 | Mullen | 404/133.2 |
| 4,349,295 | 9/1982 | Morrison . | |
| 4,359,296 | 11/1982 | Cronkhite . | |
| 4,375,351 | 3/1983 | Allen . | |
| 4,386,901 | 6/1983 | Morrison . | |
| 4,388,018 | 6/1983 | Boschung | 404/133.2 X |
| 4,408,978 | 10/1983 | Owens . | |
| 4,591,291 | 5/1986 | Owens . | |
| 4,641,995 | 2/1987 | Owens | 404/97 X |
| 4,798,494 | 1/1989 | Allen . | |
| 4,838,730 | 6/1989 | Owens | 404/97 X |
| 4,848,961 | 7/1989 | Rouillard . | |
| 4,861,188 | 8/1989 | Rouillard . | |
| 4,911,575 | 3/1990 | Tidwell | 404/97 |
| 5,096,330 | 3/1992 | Artzberger | 404/97 |

*Primary Examiner*—Mark Rosenbaum
*Assistant Examiner*—Frances Chin
*Attorney, Agent, or Firm*—Barnes & Thornburg

[57] ABSTRACT

Concrete striking equipment presented in the form of a framework mounted longitudinal bar operating in a vibratory relationship in a horizontal plane because of an off-center rotating weight defining a part of the powering means. While basically developed for striking concrete, the invention's field of utility extends to the leveling and/or grading of earth, rock and the like. The aforesaid framework is physically similar to that of a commonly known WEED EATER apparatus, where an enhanced vibratory effect is resiliently achieved through a specialized mounting arrangement.

41 Claims, 1 Drawing Sheet

CONCRETE STRIKING EQUIPMENT

The present application is a continuation-in-part of patent application Ser. No. 619,497, filed Nov. 29, 1990, now abandoned with the same title and inventor.

BACKGROUND OF THE INVENTION

As is known, the usage of concrete as a building material is widespread and ever growing, where, although various mechanical finishing approaches are already available, striking and/or grading primarily remains a hand-operation.

A typical procedure employed in connection with the placing of concrete involves strike-off; bull float, as for rock washdown; and, finally, hand-finishing, typically involving the use of trowels. The preceding is time consuming and, therefore, a need has arisen for more rapidly completing the latter but, at the same time, with professional quality results.

DESCRIPTION OF THE INVENTION

The invention overcomes the preceding problems and/or inherent differences by providing concrete striking equipment basically powered by an off-center or out of balance member and achieving vibrating in a horizontal plane to accomplish concrete placement similar to a hand operation.

The equipment presented herein functions in a continual vibratory effect, where such, per se, is basically not new, but, instead, serves a particular improvement. No vertical tamping is intentionally involved (the only vertical tamping might be that occasioned as a result of inherent stray forces).

Broadly, the operator of the striker is generally patterned after a commonly known WEED EATER, such providing striking based on the use of an extended wooden member, affording the desired weight, and, also, arranged to include a number of resilient components which not only add to vibration, but smooth operator control.

BRIEF DESCRIPTION OF THE FIGURES

A better understanding of the present invention will become more apparent from the following description, taken in conjunction with the accompanying drawing, wherein.

Figure 1:
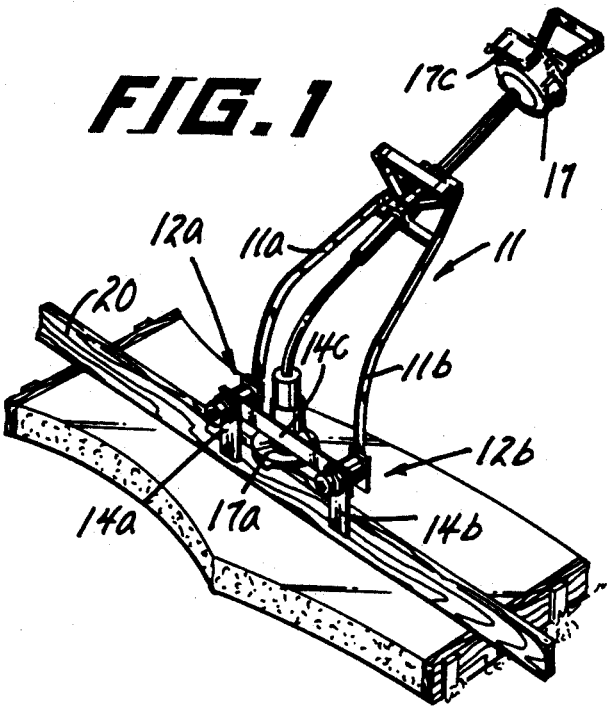
FIG. 1 is a perspective view showing concrete striker equipment in accordance with the teachings of the present invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

Referring now to the figures, the concrete striking equipment of the invention is presented as a framework 11 in the form of two arms **11*a*,11*b* bowed rearwardly to the location of the pusher/operator. The framework 11, mounts, through linkage assemblies 12*a*,12*b* and associated vertical and horizontal straps 14*a*,14*b* and 14*c*, an elongated length of lumber 20**.

Figure 4:
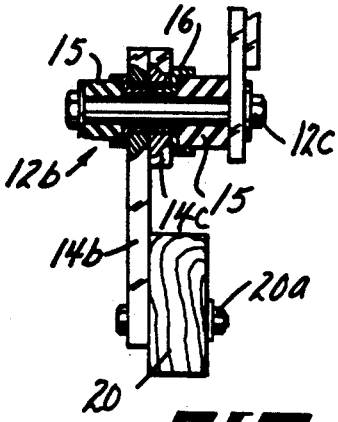

Assemblies **12*a*,12*b* extend through the straps 14*a*,14*b* and 14*e* and include resilient elements 15, spacers 16, and securing means, such as nuts 12*c*. The arms 11*a*,11*b* of the framework 11 have lower end portions mounted onto the linkage assemblies 12*a*,12*b* (see FIG. 4** in this connection).

The powering of the instant concrete striking equipment is achieved by a self-contained (on the equipment) electrical/mechanical source 17 (an electric motor or a gasoline motor) operating mechanism 17' supported by framework 11 (and extending through a collar **17*a'* mounted onto a surface of strap 14*c*) and typically defined as a rotating, off-center, weight 17*a*, approximating the arrangement commonly found in the powering of the conventionally known "WEED EATER". A power control box 17*c* is also mounted on the framework 11, providing, for example, a speed adjustment (not shown) for the rotating web weight 17*a***.

Figure 2:
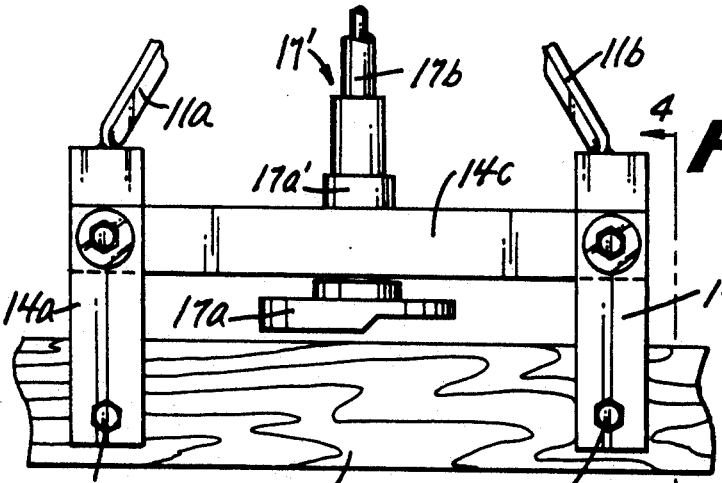
FIG. 2 is a view in front elevation, detailing the primary power source.
Figure 2B:
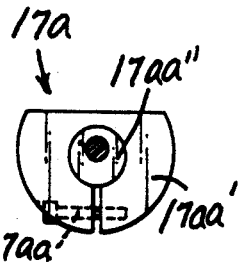
FIG. 2B is a top plan view detailing another position of the vibrator head of the powering means.
Figure 3:
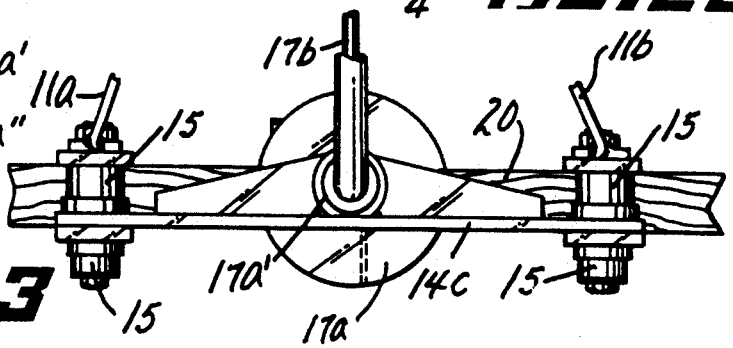
FIG. 3 is a top plan view, looking downwardly on FIG. 2, further detailing the invention; and, FIG. 4 is a view in side elevation, partly in vertical action, and taken at line 4—4 on FIG. 2 and looking in the direction of the arrows, still further detailing the invention.

More specifically, added assembly techniques are revealed in the various figures, as the mounting of the rotatable weight **17*a* and the powering thereof through a drive cable 17*b* (not detailed, but apparent in FIGS. 2 and 3). The securement of the elongated length of lumber 20, as through nuts and bolts 20*a*, shown in FIGS. 2 and 4, where the complete assembly of the elongated lumber length 20, together with the securement of the powering of the off-center weight 17*a*, is particularly shown in FIG. 3**.

Figure 2A:
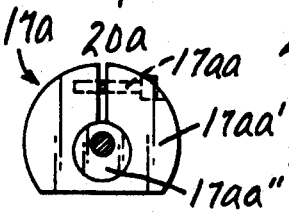
FIG. 2A is a top plan view detailing one position of the vibrator head of the powering means.

The off-center weight **17*a* achieves vibration in a horizontal plane, where the arrangement avoids vertical tamping even though off-center weight 17*a* is directly above the lumber 20 and normal thereto. Vibration can be adjusted by, as stated, throttle control through r.p.m. change; and, by rotating the outer portion 17*aa'* of wight 17*a* around inner portion 17*aa''* upon release of locking screw 17*aa* (see FIGS. 2A—minimum vibration setting and 2B**—maximum vibration setting).

As should be evident, therefore, the invention presents concrete striking equipment which is relatively light in weight, highly maneuverable uses less power since no lifting (of weight of equipment) is involved, and, as well, is readily responsive to the operator's control of available vibration in a horizontal plane to accomplish material leveling.

The use of resilient (rubber) absorbers 15 at various assembly sites, as mentioned, serves to enhance the achieved vibratory effort. Moreover, with the use of lumber 20 as the basis for concrete engagement, such is readily replaced, as needed, and, also, may be substituted to fulfill various overall lengths to satisfy a particular job requirement. Note that the operator is not strapped into position, and that a kick-stand (not shown) can be provided for on-site storage or the like.

The concrete striking equipment described hereabove is susceptible to various changes within the spirit of the invention, including, by way of example, in proportioning; the precise arrangement of mounting the powering arrangement on the framework; the actual assembly techniques making for ready fabrication; and, the like. Thus, the preceding should be considered illustrative and not as limiting the scope of the following claims:

I claim:

1. Concrete striking equipment comprising a framework presenting a handle portion and an operating portion in selective engagement with a material under process, said operating portion including an elongated bar secured onto said framework, and powering means mounted on said framework and including a control device, said powering means including means for presenting an off-center rotating weight for rotation about a vertical axis of rotation and means for rotating the off-center rotating weight relative to the framework about the vertical axis of rotation.

2. The concrete striking equipment of claim 1 where said powering means directly overlies said elongated bar.

3. The concrete striking equipment of claim 1 where the rotating means includes an electro-mechanical drive unit that is coupled to the framework and arranged in a self-contained position on the equipment.

4. The concrete striking equipment of claim 1 where said operating portion includes linkage assemblies and associated vertical and horizontal straps.

5. The concrete striking equipment of claim 4 where said elongated bar mounts onto said framework through arrangements including resilient means serving hinge points for said linkage assemblies and said associated vertical and horizontal straps.

6. The concrete striking equipment of claim 4 where said resilient means maintain vibration predominantly on said elongated bar in contrast to said operator.

7. A portable concrete screed comprising a frame, means for engaging concrete, means for vibrating the engaging means in a horizontal plane relative to the frame, the vibrating means including an off-center weight, means for rotating the off-center weight about a vertical axis of rotation, and means for imparting vibration to the engaging means during rotation of the off-center weight about its vertical axis of rotation so that the engaging means moves in said horizontal plane relative to the frame.

8. The screed of claim 7, wherein the rotating means includes a collar mounted on the imparting means, a rotatable shaft supported by the collar and coupled to the off-center weight, and means for turning the rotatable shaft to rotate the off-center weight about its vertical axis of rotation.

9. The screed of claim 8, wherein the turning means includes a motor, means for mounting the motor on the frame to move therewith, and means for coupling the motor to the rotatable shaft.

10. The screed of claim 8, wherein the imparting means includes a bracket and the collar is mounted on the bracket.

11. The screed of claim 10 wherein one portion of the bracket is coupled to the engaging means and another portion of the bracket includes a pair of resilient vibration absorbers mounted thereon and coupled to the frame to reduce transmission of vibration from the bracket to he frame.

12. The screed of claim 10, wherein the bracket includes a pair of straps extending between the frame and the engaging means and a cross member interconnecting the pair of straps and the collar is mounted on the cross member.

13. The screed of claim 12, wherein the off-center weight lies under the cross member and above the engaging means.

14. The screed of claim 7, wherein the imparting means includes a pair of straps extending between the frame and the engaging means and a cross member interconnecting the pair of straps and means for rotatably coupling the off-center weight to the cross member.

15. The screed of claim 14, wherein the off-center weight is positioned to lie under the cross member and above the engaging means.

16. The screed of claim 7, wherein the engaging means includes a horizontally extending elongated member arranged to lie in perpendicular relation to the vertical axis of rotation of the off-center weight.

17. The screed of claim 16, wherein the imparting means includes a cross member and means extending between the frame and the elongated member for supporting the cross member in spaced-apart relation to the elongated member and the off-center weight lies between the cross member and the elongated member.

18. The screed of claim 17, wherein the rotating means includes a collar mounted on the cross member, a rotatable shaft supported by the collar and coupled to the off-center weight, and means for turning the rotatable shaft to rotate the off-center weight about its vertical axis of rotation.

19. The screed of claim 7, wherein the imparting means includes a bracket coupled to the engaging means and a pair of resilient vibration absorbers mounted on the bracket and the frame and the frame is configured to provide an operator handle and is coupled to the pair of vibration absorbers to minimize transfer of vibration from the bracket to the frame and the operator handle on the frame.

20. The screed of claim 19, wherein the frame includes a handle section, a first leg extending from the handle section to one of the resilient vibration absorbers, and a second leg extending from the handle section to the other of the resilient vibration absorbers.

21. The screed of claim 20, wherein the rotating means includes a motor mounted on the frame and a rotatable shaft coupled at one end to the motor and at another end to the off-center weight and arranged to lie between the first and second legs.

22. The screed of claim 7, wherein the off-center weight includes an inner portion and an outer portion rotatable around the inner portion.

23. The screed of claim 22, wherein the rotating means includes a rotatable shaft, the inner portion includes a round member eccentrically mounted to the rotatable shaft, and the outer portion includes a split member rotatable around the round member and means for drawing one portion of the split member closer to another portion of the split member to lock the split member in a fixed position on the round member.

24. The screed of claim 7, wherein the vibrating means further includes means for adjusting the magnitude of vibration generated by the rotating off-center weight independent of the rotational velocity of the off-center weight about its vertical axis of rotation.

25. The screed of claim 24, wherein the adjusting means includes an offset outer portion rotatable about the off-center weight and means for selectively locking the outer portion to the off-center weight.

26. The screed of claim 25, wherein the offset outer portion includes first and second legs and the locking means includes a locking screw interconnecting the first and second legs and rotating to draw the first and second legs closer together to lock the offset outer portion to the off-center weight.

27. A portable concrete screed comprising
means for engaging concrete,
a bracket mounted on the engaging means,
an off-center weight,
means for mounting the off-center weight for rotation about a vertical axis of rotation to generate vibration transmitted to the engaging means by the bracket so that the engaging means vibrates in a horizontal plane in response to rotation of the off-center weight about its vertical axis of rotation, and
means for rotating the off-center weight about its vertical axis of rotation to vibrate the bracket and the engaging means.

28. The screed of claim 27, further comprising handle means for lifting the engaging means relative to underlying concrete without interfering with rotation of the off-center weight.

29. The screed of claim 28, wherein the handle means includes a frame, a handle on the frame, and means for absorbing vibration to minimize transmission of vibration from the bracket to the frame.

30. The screed of claim 29, wherein the absorbing means includes a pair of resilient vibration absorbers mounted on the bracket, the frame includes a pair of legs, and each of the legs is mounted on one of the resilient vibration absorbers.

31. The screed of claim 28, wherein the rotating means includes a rotatable shaft, a sleeve around the rotatable shaft, and motor means for turning the rotatable shaft to rotate the off-center weight about its vertical axis of rotation and the handle means includes a frame coupled to the bracket and to the sleeve and a handle mounted on the frame.

32. The screed of claim 27, wherein the mounting means includes a collar mounted on the bracket and a rotatable shaft coupled to the off-center weight and the rotating means includes means for turning the rotatable shaft to rotate the off-center weight about its vertical axis of rotation.

33. The screed of claim 32, wherein the turning means includes a frame mounted on resilient vibration absorbers mounted on the bracket and a motor mounted on the frame and connected to the rotatable shaft.

34. The screed of claim 27, wherein the off-center weight includes an inner portion appended to the rotating means, an outer portion rotatable around the inner portion to vary the center of mass of the off-center weight relative to the vertical axis of rotation of the off-center weight, and means for selectively locking the outer portion to the inner portion to fix the center of mass of the off-center weight at a predetermined distance away from the vertical axis of rotation of the off-center weight.

35. A portable concrete screed comprising
a frame including a handle portion,
means for engaging concrete, and
means for vibrating the engaging means, the vibrating means including a motor mounted on the handle portion of the frame for movement therewith, a vibrator mounted on the engaging means and arranged to lie below and in spaced-apart relation to the motor, and means extending along the frame for coupling the motor to the vibrator to drive the vibrator in response to operation of the motor, the frame including a lower portion coupled to the engaging means and an upper portion including an elongated rod carrying the hand grip portion, and the motor is mounted to an end of the elongated rod.

36. The screed of claim 35, wherein the motor includes a rotatable output shaft, the vibrator includes a rotatable input shaft, and the coupling means includes a drive shaft interconnecting the rotatable output and input shafts.

37. The screed of claim 36, wherein the drive shaft is curved.

38. The screed of claim 35, wherein the elongated rod is formed to include a passageway extending therethrough and the coupling means extends through the passageway to interconnect the motor to the vibrator.

39. The screed of claim 35, wherein the vibrating means further includes throttle means for controlling output of the motor delivered to the coupling means to regulate the magnitude of vibration transmitted to the engaging means and the throttle means is mounted along the handle portion of the frame.

40. A portable concrete screed comprising
a frame including a handle portion,
means for engaging concrete, and
means for vibrating the engaging means, the vibrating means including a motor mounted on the handle portion of the frame for movement therewith, a vibrator mounted on the engaging means and arranged to lie below and in spaced-apart relation to the motor, and means extending along the frame for coupling the motor to the vibrator to drive the vibrator in response to operation of the motor, the vibrating means further including a bracket coupled to the engaging means and a pair of resilient vibration absorbers are mounted on the bracket and coupled to the frame to reduce transmission of vibration from the bracket to the frame, and the vibrator is mounted on the bracket.

41. The screed of claim 40, wherein the vibrating means further includes a collar mounted on the bracket and the coupling means is supported by the collar.

* * * * *